United States Patent [19]

Gable

[11] Patent Number: 4,789,316

[45] Date of Patent: Dec. 6, 1988

[54] GEAR LUBRICATION PUMP FOR AN AIR MOTOR

[75] Inventor: Duane S. Gable, Ulster, Pa.

[73] Assignee: Ingersoll-Rand Company, Woodcliff Lake, N.J.

[21] Appl. No.: 947,159

[22] Filed: Dec. 29, 1986

[51] Int. Cl.[4] ..... F01C 1/344; F01C 21/04

[52] U.S. Cl. ..... 418/88; 418/94; 418/100; 418/270

[58] Field of Search ..... 418/1, 270, 88, 100, 418/94, 98, 102; 184/6.12, 6.16, 31

[56] References Cited

U.S. PATENT DOCUMENTS 1,913,844 6/1933 McCormack ..... 418/88

3,088,660 5/1963 Voggenthaler ..... 418/88

3,129,642 4/1964 Sorensen et al. ..... 418/270

4,568,253 2/1986 Wood ..... 418/88

FOREIGN PATENT DOCUMENTS 2084652 4/1982 United Kingdom ..... 418/102

*Primary Examiner*—John J. Vrablik

*Assistant Examiner*—Leonard P. Walnoha

*Attorney, Agent, or Firm*—Arthur N. Trausch

[57] ABSTRACT

This invention relates to a lubrication system for a gear assembly in a sealed housing coupled to an air motor. The lubrication system includes a screw pump powered by the air motor to move lubricated fluid completely through the critical parts in the sealed housing.

4 Claims, 1 Drawing Sheet

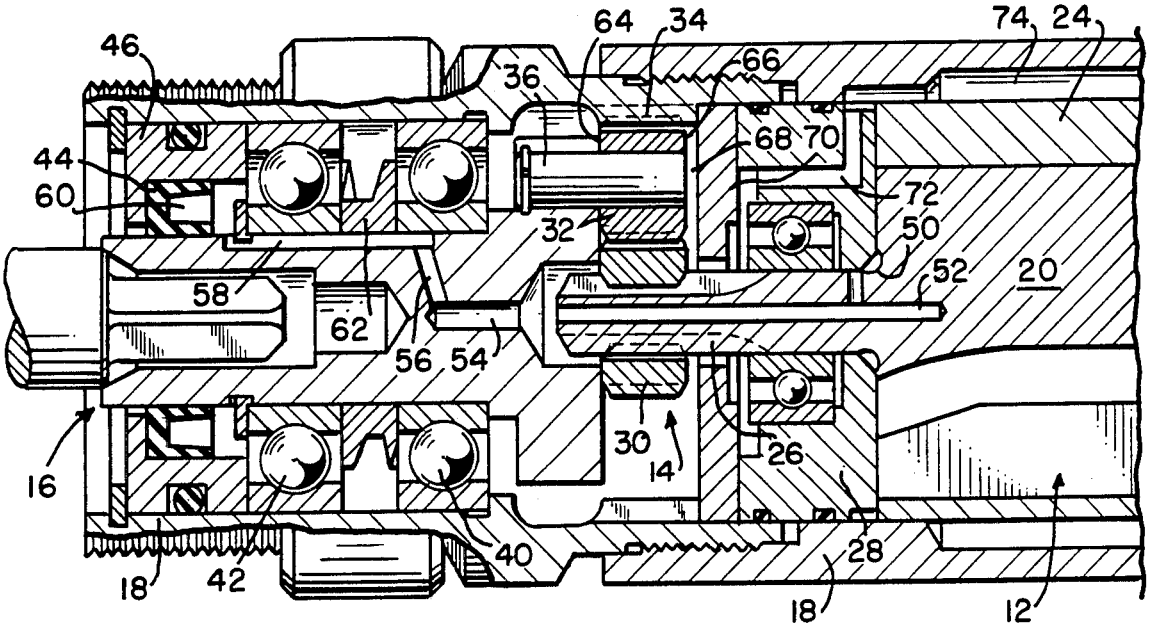
FIG. 1
FIG. 2
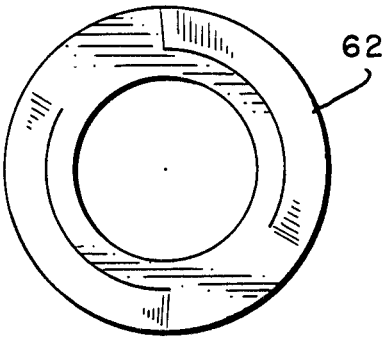
FIG. 3
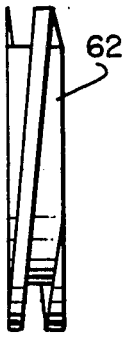

GEAR LUBRICATION PUMP FOR AN AIR MOTOR

BACKGROUND OF THE INVENTION

This invention relates to a lubrication system for a gear assembly coupled to an air motor, and more particularly to a lubrication system for gears isolated in a sealed housing.

Air motors are often coupled to a gear system to reduce the speed or increase the torque at the point of application. Lengthy free speed running of these geared air motors may reduce the life of the motor or gearing unless sufficiently lubricated. A known and simple way of lubricating a geared motor is to direct a small portion of lubricant ladened motive fluid axially forward from the air motor through the gears. The fluid is then vented to atmosphere at the front of the mechanism. However, certain air motor applications require that no contamination reach the work piece. The forward portion of the housing is sealed to prevent any venting. In this type of geared air motor, the initial fluid pressure of the diverted fluid is not great enough to move the lubricated fluid completely through the lubrication passageways in the sealed housing and then back to the exhaust passageway.

SUMMARY OF THE INVENTION

An object of this invention is to lubricate a sealed portion of an air motor which requires lengthy free speed running for a large portion of its duty cycle.

Another object of this invention is to enhance the lubrication and air circulation through the sealed gear assembly of an air motor.

An advantage of this invention is that it is simple to construct and involves minimal moving parts.

The objects and advantages of the present invention are attained by replacing a spacer ring with a screw pump and powering the pump by the air motor to move lubricated fluid completely through the sealed gear assembly coupled to the air motor.

BRIEF DESCRIPTION OF THE DRAWINGS

FIG. 1 is a sectional view of an air powered mechanism showing an air motor and a sealed gear assembly.

FIG. 2 is a front view of the pump of the present invention.

FIG. 3 is a side view of the pump.

DETAILED DESCRIPTION OF THE INVENTION

A typical portion of an air powered mechanism is shown in FIG. 1. The mechanism includes an air motor, shown generally by 12, a gear assembly 14 and an output spindle assembly 16, all contained in a sealed housing assembly 18.

The air motor operates in the conventional manner and includes a rotor 20 mounted eccentrically for rotation in a cylinder 24. A splined rotor shaft 26 extends axially forward from the rotor. An end plate 28 seals the cylinder.

The speed reducing gear assembly 14 includes a pinion or sun gear 30 mounted on the rotor shaft spline 26. Appropriate planetary gears 32 are meshed between the pinion gear 30 and the ring gear 34 fixed to the inner diameter of the housing. The planetary gears are rotatably attached to the spindle assembly 16 by pins 36. Thus, in the conventional manner, as the air motor causes rotor shaft 26 to rotate, the gear assembly 14 reduces the rotational speed transmitted to the spindle assembly 16 accordingly.

Bearings 40 and 42 support the spindle assembly 16 for rotation in the housing 18. Annular spring seal 44 forms a seal with the forward seal assembly 46 between the housing 18 and spindle assembly 16. This effectively seals the forward portion of the mechanism from atmosphere. Nothing from inside of the mechanism can contaminate the workpiece. However this also creates a circulation dead-end in the forward seal chamber 60.

An air cavity 50 is provided in the rotor end plate 28 to capture a small portion of the motive fluid. That leaks between the end plate 28 and the rotor 20 due to the pressure drop. Since the motive fluid is typically oil ladened air, the air cavity provides a pressurized source of lubricated fluid for the lubrication system. The lubricated fluid flows through center passageway 52 in the rotor shaft and into center passageway 54 of the spindle 16. The fluid flows through both the radially inner passageways formed at the gear 30 and shaft 26 interface and radially outward in passage 56 and axial forward in channel 58 to forward seal chamber 60. Up to this point, the initial fluid pressure of the captured air has provided the fluid flow. However, due to the volume expansion in the passageways, the pressure of the fluid now approaches atmospheric. Normally in previous mechanisms the fluid would now exit to the atmosphere in the general vicinity of the spindle. However, in the present situation, the seals 44 and 46 create a barrier. The lubricated fluid flow is stalled at this point and there is no further flow through the mechanism due to the low pressure differential. Thus the screw pump 62 of the present invention is needed to return the fluid to the exhaust passageway at the rear of the sealed housing.

The screw pump 62 is located between the bearings 40 and 42 which support the spindle 16 in the housing 18. The screw pump rotates with the spindle. From FIGS. 2 and 3 it can be seen that the screw pump has a thread of balanced pitch, depth and running clearance to give a proper flow gradient. A two lead thread is shown, although other balanced configurations are within the scope of this invention.

The pump thus provides the additional suction to pull the lubricated fluid through the bearing 42 and push the fluid through bearing 40 and the remainder radially outward of the lubrication passageway. The fluid passes through and lubricates the planet gears 32. A small quantity of grease is initially added to the system in appropriate places during assembly. Due to the geometric constrictions of the lubrication passageway, grease dams now form at positions 64 and 66 on the planetary and ring gear contact surfaces. Also note that lubricated fluid can penetrate behind the planetary gear at 68. Thus the critical lubrication points of the speed reducing gear assembly are lubricated. The fluid continues to flow past the thrust collar 70 and into passageway 72 before exiting the mechanism by the exhaust passageway 74.

Besides lubricating the various critical parts, the system also circulates air through the forward bearings and gears to cool parts that may be subject to heat buildup during free speed running.

It will be apparent from the foregoing that changes may be made in details of construction and configuration without departing from the spirit of the invention as defined in the following claims.

I claim:

1. A fluid lubrication system for a gear assembly coupled to an air motor comprising:

a fluid source;

a fluid exhaust;

first fluid passageways connecting said fluid source with said gear assembly, wherein said first fluid passageways further comprise radially inner passageways and radially outer passageways;

second fluid passageways connecting said gear assembly with said exhaust; and means for providing momentum to said fluid in said first and second passageways wherein said momentum providing means further comprises a fluid pressure differential in the radially inner passageways of said first passageways and a fluid pump in the radially outer passageways of said first passageways.

2. The fluid lubrication system of claim 1 wherein the fluid pump further comprises a screw pump having a balanced thread and which is rotated by the air motor.

3. The fluid lubrication system of claim 2 wherein the screw pump has a two lead thread.

4. A method of lubricating a geared air motor having radially inner and outer fluid passageways through the gears, comprising the steps of:

capturing pressurized fluid from the air motor;

circulating part of the captured fluid through the radially inner passageways by a fluid pressure differential;

pumping the remainder of the captured fluid through the radially outer passageways;

lubricating the gears with the fluid; and pumping the fluid through the remaining passageways downstream of the gears to an exhaust.

* * * * *